US010614680B2

(12) United States Patent
Adams

(10) Patent No.: US 10,614,680 B2
(45) Date of Patent: Apr. 7, 2020

(54) MOTION SENSING CARGO NET ASSEMBLY

(71) Applicant: David D. Adams, Chapin, SC (US)

(72) Inventor: David D. Adams, Chapin, SC (US)

( * ) Notice: Subject to any disclaimer, the term of this patent is extended or adjusted under 35 U.S.C. 154(b) by 759 days.

(21) Appl. No.: 14/603,598

(22) Filed: Jan. 23, 2015

(65) Prior Publication Data

US 2016/0217666 A1 Jul. 28, 2016

(51) Int. Cl.
*G08B 13/12* (2006.01)

(52) U.S. Cl.
CPC ..... *G08B 13/126* (2013.01)

(58) Field of Classification Search
None
See application file for complete search history.

(56) References Cited

U.S. PATENT DOCUMENTS 4,222,032 A 9/1980 Speer
4,550,945 A 11/1985 Englehardt
5,677,674 A 10/1997 Wolf
D411,506 S 6/1999 Davis
6,144,298 A * 11/2000 Haimovich ..... B60R 25/10 340/541
6,758,769 B2 * 7/2004 Nelson ..... A63B 24/0021 473/480
7,352,284 B2 4/2008 Krill
7,554,445 B2 * 6/2009 Script ..... G01P 13/00 310/311
2006/0289581 A1 * 12/2006 Bohlke ..... B60R 5/04 224/543
2007/0001844 A1 * 1/2007 Krill ..... G08B 13/12 340/545.1

* cited by examiner

*Primary Examiner* — Patrick N Edouard
*Assistant Examiner* — Eboni N Giles

(57) ABSTRACT

A motion sensing cargo net assembly includes a netting having a perimeter edge and a central area. A housing is mounted on the netting and a control circuit is mounted in the housing. A power supply is electrically coupled to the control circuit. A motion sensor is mounted in the housing is electrically coupled to the control circuit and a speaker is electrically coupled to the control circuit. The speaker emits an audible alarm sound when the motion sensor is turned on and detects movement of the housing.

4 Claims, 5 Drawing Sheets

MOTION SENSING CARGO NET ASSEMBLY

BACKGROUND OF THE DISCLOSURE

Field of the Disclosure

The disclosure relates to cargo net devices and more particularly pertains to a new cargo net device for retaining cargo within an area and sounding an alarm if the cargo net is tampered with.

SUMMARY OF THE DISCLOSURE

An embodiment of the disclosure meets the needs presented above by generally comprising a netting has a perimeter edge and a central area. A housing is mounted on the netting and a control circuit is mounted in the housing. A power supply is electrically coupled to the control circuit. A motion sensor is mounted in the housing is electrically coupled to the control circuit and a speaker is electrically coupled to the control circuit. The speaker emits an audible alarm sound when the motion sensor is turned on and detects movement of the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
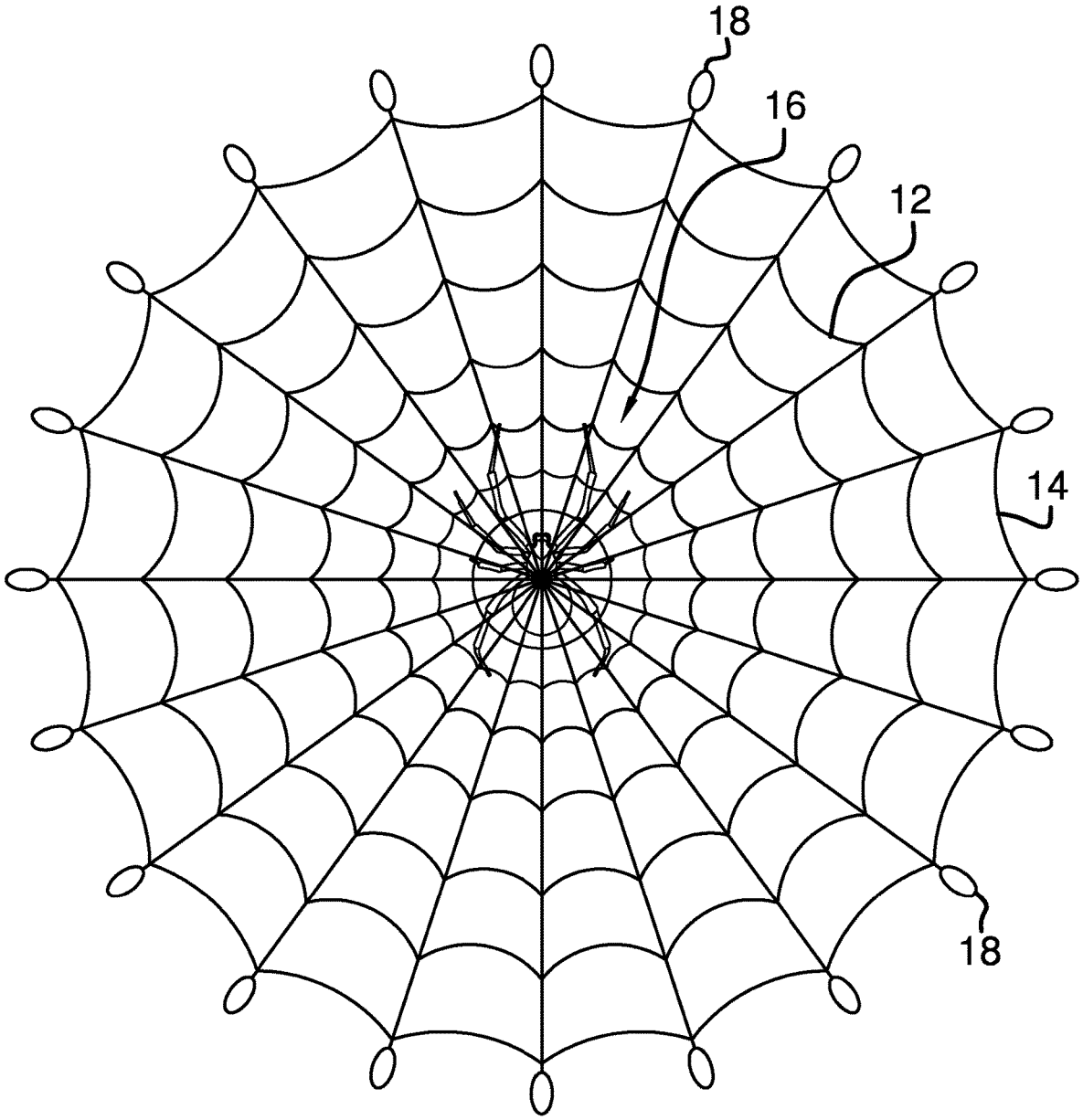
FIG. 1 is a bottom view of a motion sensing cargo net assembly according to an embodiment of the disclosure.
Figure 2:
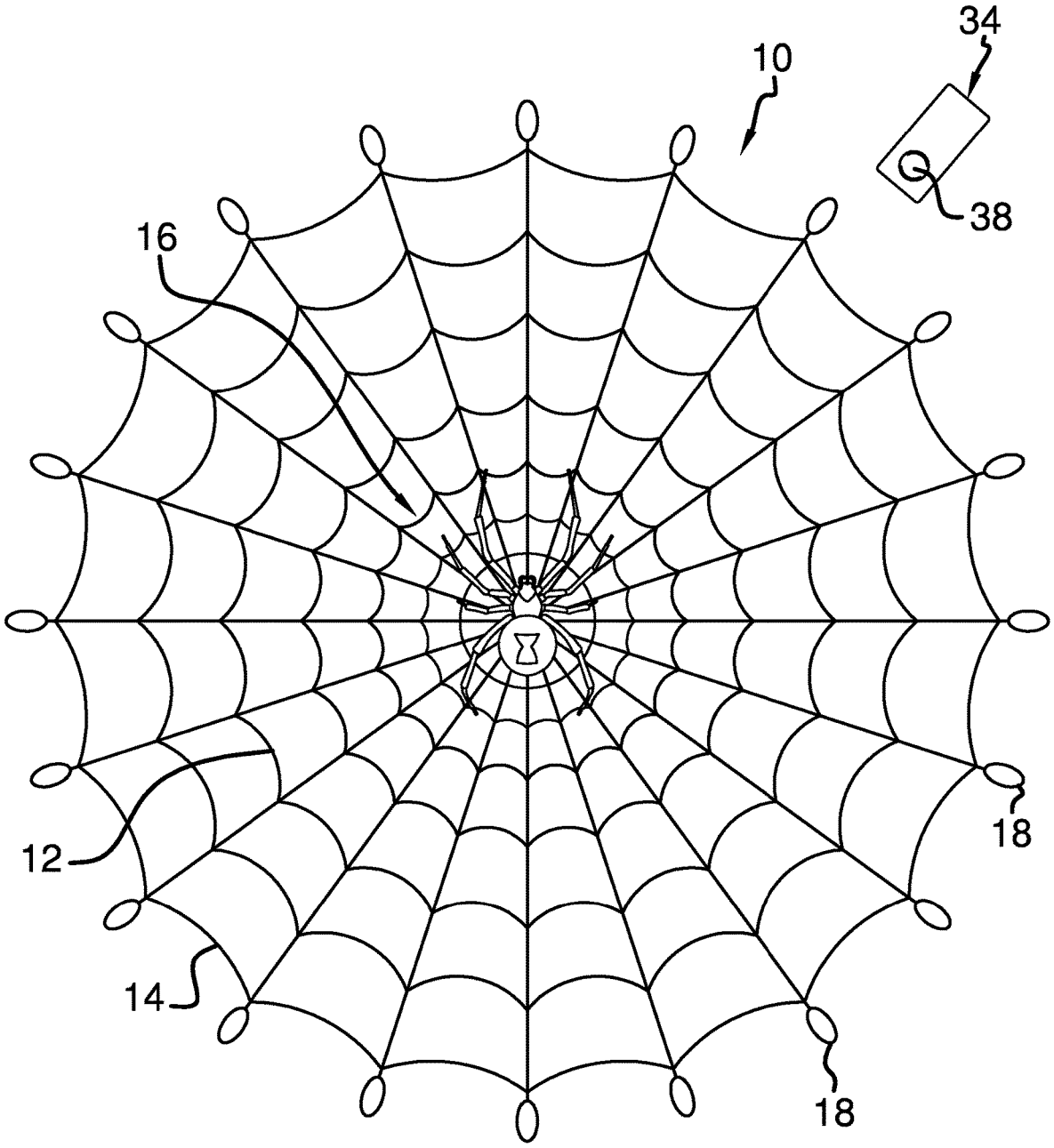
FIG. 2 is a top view of an embodiment of the disclosure.
Figure 3:
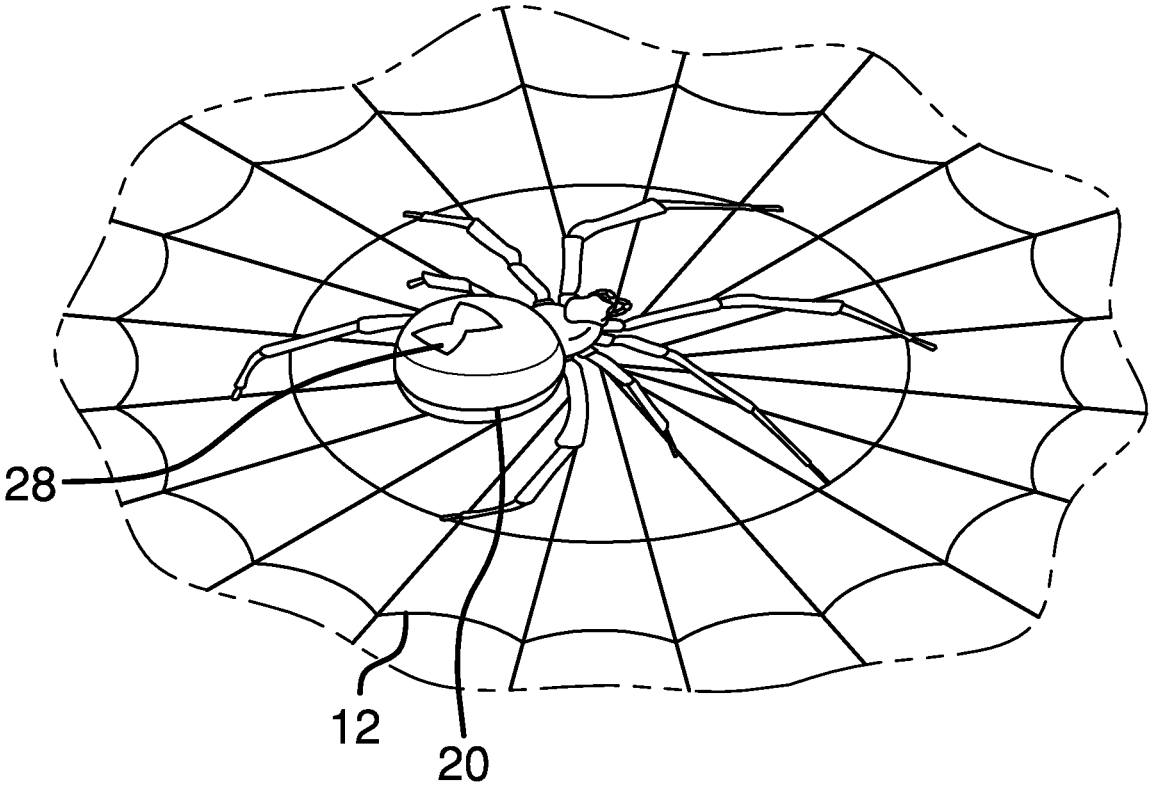
FIG. 3 is a perspective view of an embodiment of the disclosure.

With reference now to the drawings, and in particular to FIGS. 1 through 6 thereof, a new cargo net device embodying the principles and concepts of an embodiment of the disclosure and generally designated by the reference numeral 10 will be described.

As best illustrated in FIGS. 1 through 6, the motion sensing cargo net assembly 10 generally comprises a netting 12 having a perimeter edge 14 and a central area 16. The netting 12 has an open weave construction conventional to nets and may include any variety of commonly used gauges of tether material depending on the usage of the assembly 10. The netting 12 may be comprised of a resiliently stretchable material. A plurality of eyelets 18 may be attached to the netting and to facilitate attachment of the netting to any number of various objects, hooks and the like. The eyelets 18 are positioned on the perimeter edge 14. The netting 12 may have a length and width each less than approximately 15.0 feet and greater than 5.0 feet.

A housing 20 is mounted on the netting 12 and may be permanently attached to the netting 12. The housing 20 is positioned on the central area 16 and may have a shape to resemble a spider. Further, the netting 12 may be configured to resemble a web pattern. A control circuit 22, or processor, is mounted in the housing 12 and a power supply 24, which may comprise a battery, is electrically coupled to the control circuit 22. A motion sensor 26 is mounted in the housing 20 and is electrically coupled to the control circuit 22. A light emitter 28 may be mounted on the housing 20 and be electrically coupled to the control circuit 22. The light emitter 28 will emit a visible light when the motion sensor 26 is activated. A speaker 30, or sound emitter, is electrically coupled to the control circuit 22. The speaker 30 emits an audible alarm sound when the motion sensor 26 is turned on and detects movement of the housing 12. The speaker 30 is mounted in the housing 20.

A receiver 32 may be provided for receiving wireless signals. The receiver 32 is electrically coupled to the control circuit 22 and is positioned within the housing 24. A remote control 34 includes a transmitter 36 and an actuator 38 electrically coupled together. The actuator 38 actuates the transmitter 36 to send a wireless signal to the receiver 32. The control circuit 22 may be programmed to alternatingly turn the motion sensor 26 to an on position or an off position when the receiver 32 receives the wireless signal form the transmitter 36. Thus, when the actuator 38 is pressed, the control circuit 22 will turn on the motion sensor 26 and when the actuator 38 is pressed again the motion sensor 26 will be turned off. Alternatively, the remote control 34 may include separate on and off actuators.

Figure 4:
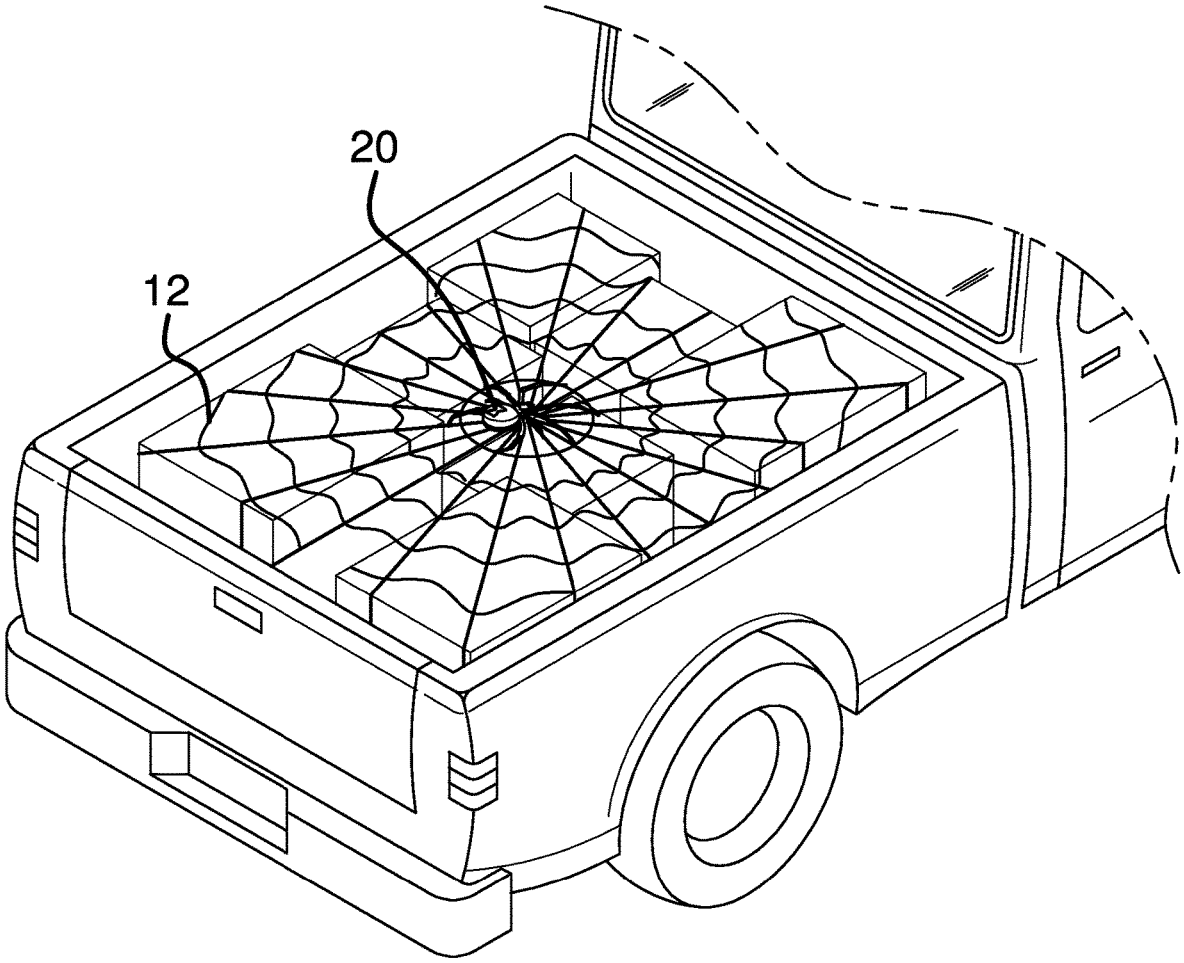
FIG. 4 is a top in-use view of an embodiment of the disclosure.
Figure 6:
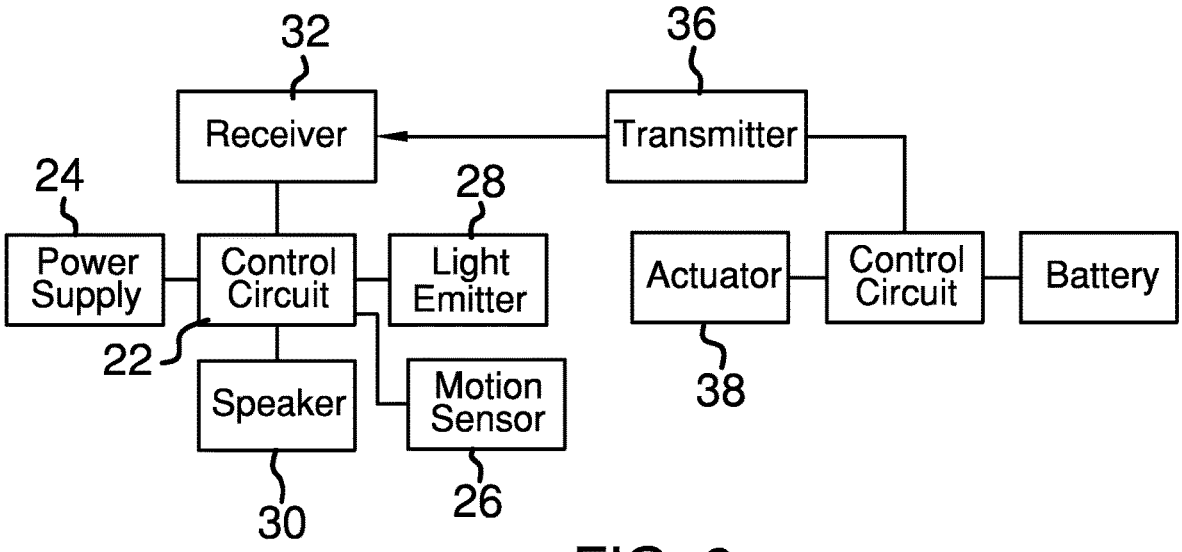
FIG. 6 is a schematic view of an embodiment of the disclosure.
Figure 5:
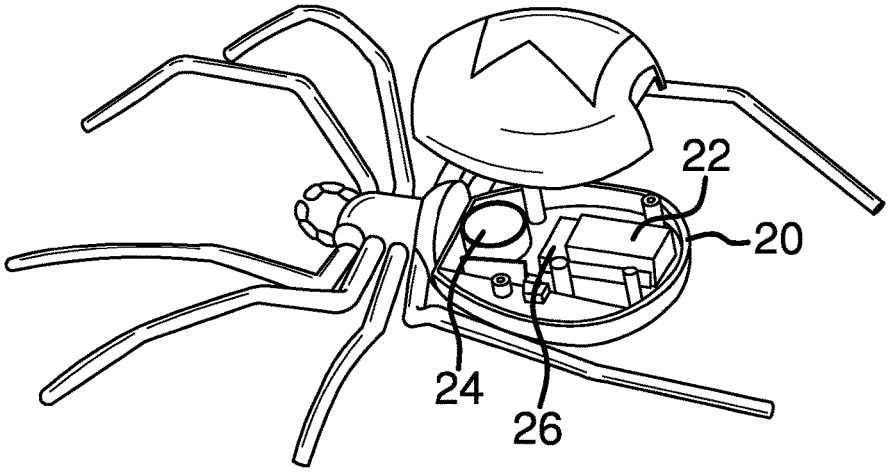
FIG. 5 is a perspective exploded view of an embodiment of the disclosure.

In use, the netting 12 is used in a conventional manner to hold done a plurality of items as is shown in FIG. 4. After the netting 12 is placed on the items, the motion sensor 26 may be turned on to sound an alarm and dissuade persons attempting to access the items. Typically the motion sensor 26 will be turned on after the user leaves the items unattended and thus in danger of being tampered with or stolen.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A motion detecting cargo net assembly comprising:

a netting having a perimeter edge and a central area;

a single housing being positioned on said netting, said single housing being positioned in said central area of said netting;

a control circuit being mounted in said housing, a power supply being electrically coupled to said control circuit;

a motion sensor being mounted in said housing being electrically coupled to said control circuit; and a speaker being electrically coupled to said control circuit, said speaker emitting an audible alarm sound when said motion sensor is turned on and detects movement of said housing, said speaker being mounted in said housing; and wherein said control circuit, said motion sensor, and said speaker define a single unit positioned within said single housing.

2. The motion detecting cargo net assembly according to claim 1, further including a plurality of eyelets being attached to said netting and being configured to facilitate attachment of said netting to an object.

3. The motion detecting cargo net assembly according to claim 1, further including:

a receiver for receiving wireless signals being electrically coupled to said control circuit and being positioned within said housing; and a remote control including a transmitter and an actuator electrically coupled together, said actuator actuating said transmitter to send a wireless signal to said receiver, said control circuit alternatingly turning said motion sensor to an on position or an off position when said receiver receives the wireless signal form said transmitter.

4. A motion detecting cargo net assembly comprising:

a netting having a perimeter edge and a central area, said netting having an open weave construction, said netting being comprised of a resiliently stretchable material;

a plurality of eyelets being attached to said netting and being configured to facilitate attachment of said netting to an object, said eyelets being positioned on said perimeter edge;

a single housing being mounted on said netting, said single housing being positioned on said central area;

a control circuit being mounted in said single housing, a power supply being electrically coupled to said control circuit;

a motion sensor being mounted in said single housing being electrically coupled to said control circuit;

a speaker being electrically coupled to said control circuit, said speaker emitting an audible alarm sound when said motion sensor is turned on and detects movement of said housing, said speaker being mounted in said single housing;

a receiver for receiving wireless signals being electrically coupled to said control circuit and being positioned within said single housing;

a remote control including a transmitter and an actuator electrically coupled together, said actuator actuating said transmitter to send a wireless signal to said receiver, said control circuit alternatingly turning said motion sensor to an on position or an off position when said receiver receives the wireless signal form said transmitter; and wherein said control circuit, said motion sensor, and said speaker define a single unit positioned within said single housing.

* * * * *